United States Patent [19]

Kolosov et al.

[11] 4,152,880

[45] May 8, 1979

[54] DEVICE FOR PACKING FLAT ARTICLES

[76] Inventors: Ivan A. Kolosov, ulitsa Astrakhanskaya, 118, kv. 54; Jury E. Ivanyatov, ulitsa M. Zatonskaya, 21; Anatoly K. Khoroshilov, prospekt Entuziastov, 26-a, kv. 36, all of Saratov, U.S.S.R.

[21] Appl. No.: 830,620

[22] Filed: Sep. 6, 1977

[51] Int. Cl.[2] ..... B65B 9/02; B65B 11/50

[52] U.S. Cl. ..... 53/553; 156/515

[58] Field of Search ..... 53/180 R, 182 R, 191, 53/192; 156/515, 522

[56] References Cited

U.S. PATENT DOCUMENTS

| | | | |
|---|---|---|---|
| 2,951,322 | 9/1960 | Wood | 53/180 X |
| 3,010,265 | 11/1961 | McClosky | 53/180 X |
| 3,633,333 | 1/1972 | Schlemmer et al. | 53/182 |
| 4,063,978 | 12/1977 | Badger et al. | 156/517 |

*Primary Examiner*—Robert Louis Spruill

*Attorney, Agent, or Firm*—Lackenbach, Lilling & Siegel

[57] ABSTRACT

Disclosure is made of a device for packing flat articles, mainly battery electrodes into a separating material, wherein a bed supports a grip which moves the article to be packed jointly with the material. Installed in line with said grip on said bed is a material feeding mechanism in the form of two reels mounted on parallel axles. The grip is linked kinematically with the carriage of the material feeding mechanism, said carriage reciprocating jointly with the grip. A guide with a slot receiving the article to be packed, is mounted on the carriage, the slot being limited by a fixed stop on the side opposite to the grip.

5 Claims, 3 Drawing Figures

DEVICE FOR PACKING FLAT ARTICLES

FIELD OF THE INVENTION

The present invention relates to the manufacture of storage batteries and, more particularly, to a device for packing flat articles, mainly battery electrodes, into a separating material.

The device according to the invention can find extensive application in industry for wrapping various articles into packing materials.

The device according to the invention will be used most successfully for automating the packing of electrodes of nickel-cadmium storage batteries of a high specific power capacity, made up of thin electrodes packed into extra-thin low-strength separating material, e.g. in the storage batteries employed in aviation, battery-powered cars, etc. This device increased the output by automating the most labor-consuming operations in storage battery production, which have hitherto been performed manually, and improves the quality of the packed electrodes due to uniform stretching of the separating material on the surface of the electrode.

The problem of mechanizing the packing of electrodes of storage batteries of a high specific power capacity consists of the thin low-strength battery electrodes being liable to bend during application of the separating material which results in wrinkling near the seams and in other defects which prevent the mechanization of this most labor-consuming operation. Therefore the electrodes of such batteries are packed in the USSR and by the prominent foreign firms mainly by the use of manual labor.

DESCRIPTION OF THE PRIOR ART

Known in the prior art is a device for packing flat articles comprising a material feeding mechanism in the form of two reels spaced apart from each other and installed on parallel axles, a guide in the form of a shaped templet carrying the article to be packed, and a gripping mechanism with gripping elements. However, this device has not been used for packing battery electrodes because the design of the guide and gripping elements fails to ensure quality packing with the required tight fitting of the separating material against the entire surface of the electrode since the electrode in this device may be displaced relative to the separating material and the separating material may be distorted during the transfer.

SUMMARY OF THE INVENTION

An object of the present invention is to provide a simple and reliable device for packing flat articles.

Another object of the invention is to reduce the amount of required labor and to improve the quality of packing of electrodes.

These and other objects are accomplished by providing a device for packing flat articles, mainly battery electrodes in a separating material, comprising a material feeding mechanism, in the form of two reels spaced apart from each other and installed on parallel axles, and a guide for the material carrying the article to be packed, said article being moved jointly with the material by a grip. The guide for the material has a slot for accommodating the article to be packed which is open at the side of the grip and limited at the other side by a fixed stop. This guide is installed on a carriage which is reciprocated jointly with the grip by an adjustable kinematic linkage.

The device for packing flat articles according to the present invention ensures automation of assembly of the electrodes with the separating material in nickel-cadmium storage batteries of a high power capacity comprising thin electrodes packed in extra-thin low-strength separating material, e.g. in the batteries employed in aviation, battery-powered cars, etc. It reduces the amount of labor required, increases the output and improves the quality of electrode separation. This is achieved by making the electrode guides in the form of a slot and combining them with the guide for the material, and by ensuring accurate fixing of the electrode throughout the cycle of covering it with the separating material and transferring it jointly with the material by the grip.

This improves the quality of packing and eliminates the possibility of wrinkling and distortion of the separating material and electrode.

The operating elements of the material feeding mechanism and of the grip of this design allow the working cycle to be performed at a higher speed which increases the output of the device.

The device is intended for use in automatic battery assembly lines though it can also serve as an individual automatic machine for packing the electrodes of all types of batteries provided with similar separating material.

Simplicity and reliability of the device give reason for anticipating its wide employment in other branches of industry for packing flat articles.

BRIEF DESCRIPTION OF THE DRAWINGS

Now the invention will be described in detail by way of examples with reference to the accompanying drawings in which.

DETAILED DESCRIPTION OF THE INVENTION

Figure 1:
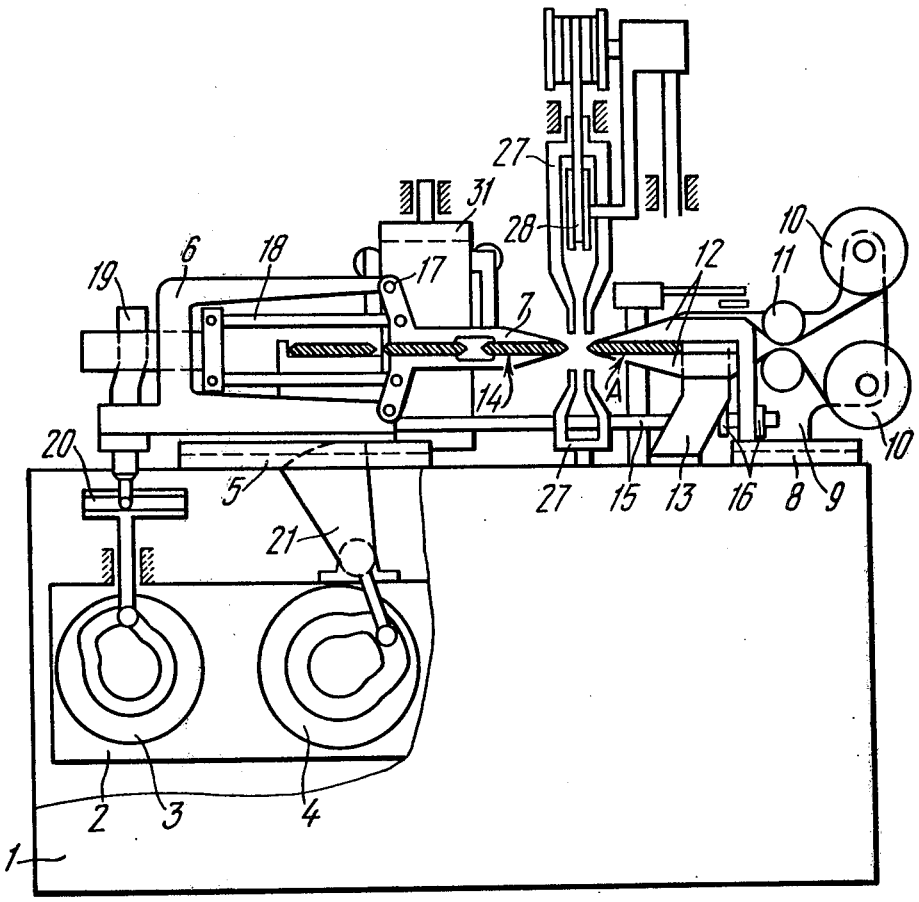
FIG. 1 is a side elevational view of the device for packing flat articles.

The device for packing flat articles will now be described by considering an embodiment of the device for packing battery electrodes in separating materials.

Such a device according to the invention comprises a bed 1 (FIG. 1) accommodating a drive 2 with camshafts. These camshafts carry a cam 3 actuating the gripping mechanism and a cam 4 reciprocating said mechanism in the course of the packing operation.

The upper plate of the bed 1 supports guides 5 installed on which with a provision for horizontal reciprocation is the housing 6 of the gripping mechanism with a grip 7. Secured near and in line with the guides 5, on the upper plate of the bed 1, are guides 8 on which the carriage 9 of the material feeding mechanism is mounted, said carriage being capable of horizontal reciprocation. Installed on parallel axles of the carriage 9 are reels 10 (FIGS. 1 and 2) with the packing material, said reels being spaced apart from each other. Mounted parallel with the reels 10 on the carriage 9 are rollers 11 and a guide 12 for the material. The guide 12 has a slot A (FIGS. 1, 3) which is open at the side of the grip 7 and limited at the opposite side by a fixed stop 13 secured directly on the bed 1. The dimensions of the slot A correspond to those of the article to be packed, in this case the electrode 14, and the height of slot A corresponds to the thickness of fixed stop 13, thus permitting the guide 12 to move freely together with the carriage 9. The body of the carriage 9 is connected with the housing 6 of the gripping mechanism 7 by a rod 15 (FIGS. 1, 3) whose free end carries adjustable stops 16 which interact with the faces of the body of the carriage 9. The grip 7 has the form of two jaws installed on parallel axles 17 in the housing 6 (FIG. 1) and is connected with the cam 3 by links 18, a wedge transmission 19 and a rod with a slot 20, said elements fixing the electrode 14 to be packed in the grip 7.

The housing 6 of the gripping mechanism is reciprocated over the guides 5 by a toothed segment or gear 21 which interacts with the cam 4 of the drive 2.

The upper plate of the bed 1 also supports other auxiliary mechanisms whose purpose is to ensure automatic functioning of the device.

Installed near the carriage 9 (FIG. 2) is a mechanism for loading the electrodes 14 into the slot A of the guide 12, said mechanism comprising a holder 22 with electrodes 14 and a manipulator 23 installed above the holder and intended to transfer the electrodes 14 one by one from the holder 22 onto a step conveyor 24 which loads each electrode into the slot A for packing. Located on the other side of the bed, at the point of unloading the packed electrodes, is a stacker 25 installed above a replaceable holder 26 which is filled automatically with the packed electrodes 14. The welding line between the grip 7 and the carriage 8 (FIGS. 3 and 2) in the extreme left position is provided with a transverse seam welding unit consisting of two pairs of clamping rulers 27, facing each other and compressing the bands of material before welding, and a welding blade 28 which is reciprocated vertically by a drive (not shown in the drawings) between the clamping rulers 27 in the course of welding. The welding blade 28 (FIG. 2) may be made, for example, in the form of a wire 30 stretched between the rollers 29 and heated by electric current passing therethrough.

Installed near the grip 7 (FIG. 2) is a unit for welding the longitudinal seam 31, said unit comprising similarly designed clamping rulers 32 and a welding blade 33.

If it becomes necessary to wrap the articles completely from four sides, a similar unit for welding the other longitudinal seam can be installed on the opposite side of the grip 7.

The grip according to the present invention functions as follows. The ends of the separating bands 34 (FIG. 3) from both reels 10 are fitted between the rollers 11 (FIG. 3), then passed around the guides 12 and clamped between the clamping rulers 27. Then the edges of the bands 34 are welded by lowering the heated welding blade 28 between the rulers 27, and the electrode 14 is pushed into the slot A in the guides 12.

The holder 22 (FIG. 2) with the electrodes 14 is placed on the loading mechanism and the empty holder 26 is placed into the stacker 25.

Now the adjusted device is ready for operation in automatic mode.

The device is started by turning on the drive 2 (FIG. 1). The cam 3 acting via the wedge 19 and links 18 spreads apart the jaws of the grip 7; and, the cam 4 acting via the toothed segment 21 moves the housing 6 of the grip 7 to the right over the guides 5.

The link or rod 15 (FIG. 3) passes freely through the body of the carriage 9 without moving the carriage 9 until the adjustable stop 16 reaches the end of the body; from this moment on, the housing 6 of the grip 7 moves jointly with the carriage 9.

Meanwhile the open jaws of the grip 7 are located side by side with the guide 12 and move over the electrode 14 which is shifted by the stop 13 out of the slot A.

Figure 2:
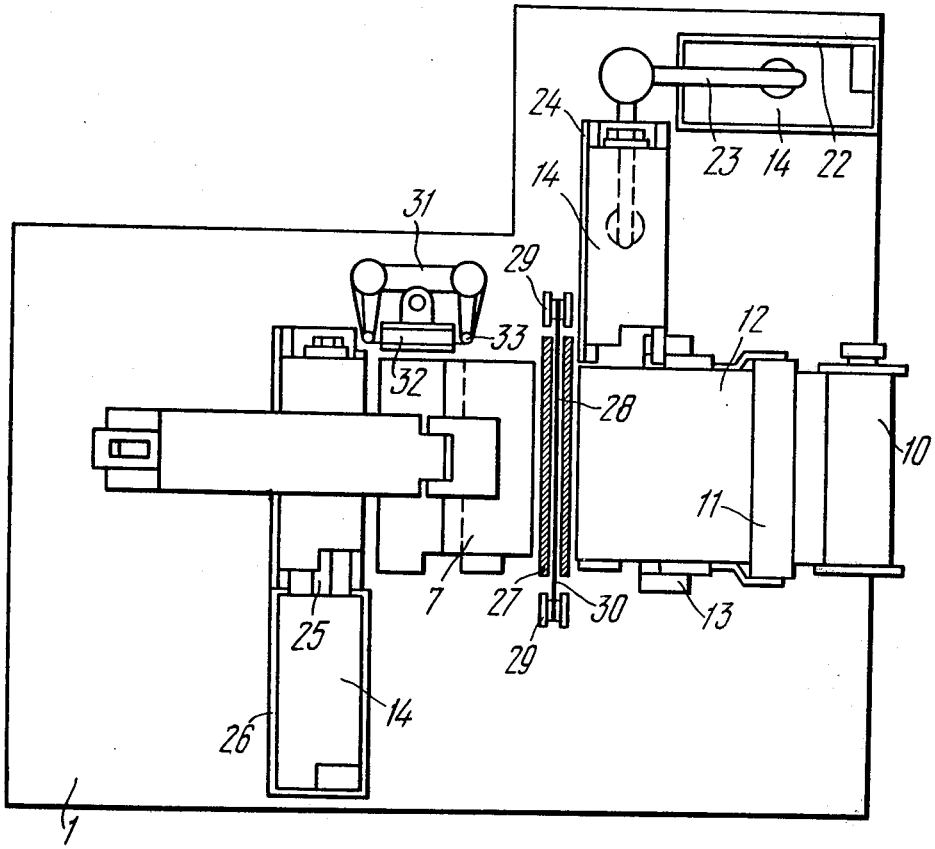
FIG. 2 is a top, plan view of the device.
Figure 3:
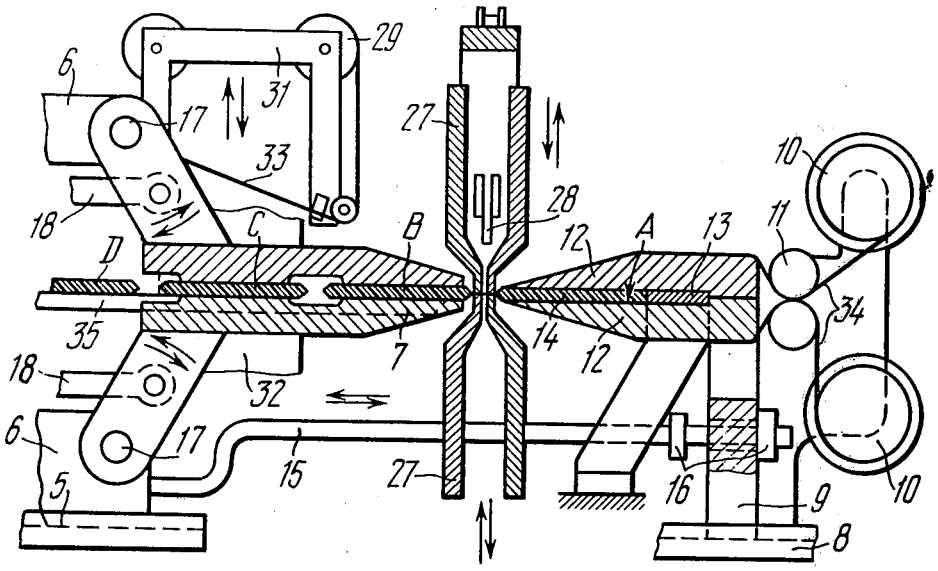
FIG. 3 is an enlarged partial side view, partly in section, showing the interaction between the carriage and the grip.

Thus, the electrode 14 with its covering material leaves the slot A of the guide 12 and immediately enters the gap between the jaws of the grip 7. When the electrode 14 occupies the extreme right position, it is located 5 – 8 mm deep in the slot A and the remaining part of the electrode, together with the separating material, is located in the gap between the jaws of the grip 7. The cam 3 (FIG. 1) closes the jaws of the grip 7 and the cam 4 of the drive 2 starts to move the housing 6 of the grip 7 to the left over the guides 5. The carriage 9 stays immovable until the right-hand or adjustable stop 16 (FIG. 3) comes in contact with its body. Meanwhile the electrode 14 moves to the left jointly with the grip 7, pulling the bands 34 from under the rollers 11 until it leaves completely the slot A of the guide 12 and moves from it the distance of 5 – 6 mm required for the passage of the rulers 27. Subsequently, the carriage 9 moves jointly with the grip 7 to the extreme left position and the electrode 14 moves to the position B (FIG. 3). At this moment the clamping rulers 27 close, clamp the bands of the separating material, a new electrode is pushed into the slot of the guide 12 and the welding blade 28 cuts the material between the clamping rulers 27, welding the edges of the bands at both sides of the blade 28. Then the rulers 27 open, the cam 3 opens the jaws of the grip 7, the housing 6 starts moving to the right, repeating the packing cycle for the next electrode, while the already welded electrode stays in place in position B (FIG. 3). While picking up the next electrode, the jaws of the grip 7 clamp two electrodes simultaneously and push the preceding electrode to the position C for welding longitudinal seam. The welding operation is performed by the blade 33 in a similar manner between the rulers 32 (FIG. 2) which clamp the material near the seams. During the next stroke of the grip 7 this electrode is moved to the position D (FIG. 3) and is placed into the holder 26 by the stacker 25 (FIG. 2).

Thus, the output of the automatic device depends on the cycle of the reciprocating motion of the grip 7 and on the time spent for welding the transverse seam by the blade 28. The welding of the longitudinal seam and loading and unloading of electrodes proceed concurrently with the main cycle. Beginning from position B the electrode moves over the supporting rulers 35 (FIG. 3). The desired tightness of packing is obtained by adjusting the position of the adjustable stops 16 on the link 15. The welding units may have various designs, but all of them must provide the formation of two seams on both sides of the blade in the course of cutting. The drive may also be of any suitable kind, e.g. pneumatic, hydraulic, etc.

The device for packing flat articles according to the present invention makes it possible to automate the operations of assembling the electrodes with the separating material, for example in nickel-cadmium storage batteries of a high power capacity consisting of thin, low-strength electrodes, because the guide for the electrode is made in the form of a slot A with a fixed stop 13 and is connected with the grip 7 by an adjustable kinematic linkage, thereby ensuring accurate fixing of the electrode 14 throughout the cycle of covering it with the material and its transfer jointly with said material by the grip 7, the degree of material tensioning being adjustable. This design of the material feeding and packing mechanism eliminates the possibility of electrode distortion and wrinkling of the separating material and allows the packing operation to be performed at high operating speeds of the working elements which increases the output of the device and ensures a high quality of electrode packing.

What is claimed is:

1. A device for packing flat articles, such as battery electrodes in a separating material comprising: a bed; a grip device including jaw means mounted on said bed for holding and moving an article to be packed jointly with said material; a material feeding mechanism, installed on said bed in line with said grip device, comprising a carriage and a pair of supply reels of material for said material feeding mechanism; means linking said carriage of said material feeding mechanism kinematically with said grip device for reciprocation jointly with said grip device; a guide for the material installed on said carriage; said guide having a slot open on at least the side facing said grip device for accommodating said article to be packed, a fixed stop limiting said slot at the side opposite to the grip device; driving means for providing said reciprocating motion to said grip device and to said carriage so that said grip device and said guide are adapted to be in joint reciprocating motion but not synchronous movement, and that accurate setting of the positions of said carriage and said grip device is ensured for the packing of said articles with a predetermined spacing between successive articles; and means for severing and sealing said material about at least two sides of said article.

2. The device according to claim 1, wherein said means for severing and sealing comprising a pair of reciprocating clamps and a heated wire blade which is vertically moved between said clamps for severing and sealing a transverse edge seam of said material when packing an article.

3. The device according to claim 2, including a sealing unit adapted to seal a longitudinal side edge seam of said material.

4. The device according to claim 3, including another sealing unit for sealing an article along the other longitudinal side edge seam, thereby completely wrapping said article about its four sides.

5. The device according to claim 1, wherein said pair of supply reels are mounted on said carriage of said material feeding mechanism.

* * * * *